United States Patent [19]

Speich

[11] Patent Number: 4,918,947

[45] Date of Patent: Apr. 24, 1990

[54] KNITTING MACHINE FOR PRODUCING WARP KNIT

[75] Inventor: Francisco Speich, Gipf-Oberfrick, Switzerland

[73] Assignee: Textilma AG, Hergiswil, Switzerland

[21] Appl. No.: 211,232

[22] PCT Filed: Sep. 11, 1987

[86] PCT No.: PCT/CH87/00116

§ 371 Date: May 12, 1988

§ 102(e) Date: May 12, 1988

[87] PCT Pub. No.: WO88/02038

PCT Pub. Date: Mar. 24, 1988

[30] Foreign Application Priority Data

Sep. 16, 1986 [CH] Switzerland ..... 3702/86

[51] Int. Cl.[5] ..... D04B 23/00

[52] U.S. Cl. ..... 66/203

[58] Field of Search ..... 66/203

[56] References Cited

U.S. PATENT DOCUMENTS 3,879,964 4/1975 Pascual ..... 66/87

3,898,820 8/1975 Brand ..... 66/87

FOREIGN PATENT DOCUMENTS 141414 3/1901 Fed. Rep. of Germany .

OTHER PUBLICATIONS

Weber, Die Wirkerei und Stickerei, Melliand Textilberichte KG.

*Primary Examiner*—Ronald Feldbaum

*Attorney, Agent, or Firm*—Toren, McGeady & Associates

[57] ABSTRACT

A weft knitting machine for producing a warp knit fabric includes knitting needles guided so as to reciprocate transversely of a knockover bit. Warp thread guides are provided for the needles and at least one reciprocating filling thread guide transverse to the needles. The knitting needles are distributed onto knitting-needle bars which are located on the same side of the fabric and are arranged alternately to one another and are capable of being driven out of phase. Each knitting-needle bar is assigned a set of warp thread guides.

16 Claims, 5 Drawing Sheets

KNITTING MACHINE FOR PRODUCING WARP KNIT

BACKGROUND OF THE INVENTION

1. Field of the Invention

The invention relates to a weft knitting machine for producing the warm knit. The weft knitting machine includes knitting needles guided reciprocatingly transverse to a knockover bit, warp thread guides assigned to the needles, and at least one reciprocating filling thread guide transverse to the needles.

2. Description of the Prior Art

Warp knit fabrics of the type mentioned at the beginning are known in many forms. Such fabrics can be produced only in limited fineness, since the knitting needles cannot be as thin and cannot be placed as closely together as might be desired. Both the filling thread guide and the warp thread guide repaire a certain distance between the knitting needles to be able to lay a filling thread or the warp threads.

The object of the invention is to design a warp knit fabric of the type mentioned at the beginning and a weft knitting machine for producing the said fabric so that the production of a fine warp knit fabric is possible.

SUMMARY OF THE INVENTION

Pursuant to the invention, the object is accomplished by the knitting needles being uniformly distributed onto two knitting-needle bars lying on the same side of the goods and are arranged alternately to one another and capable of being alternatingly driven, wherein each knitting-needle bar is assigned a set of warp thread guides. Owing to the fact that the stitches of every second warp thread stitch wale are displaced one partial stitch with respect to the stitches of every first warp thread stitch wale, the stitches of a row are not all produced at the same time, but in two stages, two sets of knitting needles being required for the purpose, which needles are brought into action out of phase, i.e., one after the other. The production of a course is thus divided into two stages, so that virtually twice as many stitches per course can be provided as was hitherto the case with the finest warp knit fabrics. While previously the limit of stitches was 8 to 10 stitches per cm, now up to 20 switches per cm of width of the warp knit fabric can be provided. The warp knit fabric is distinguished by an exceptional fineness, which substantially improves the appearance and the feel of the fabric.

For the weft knitting machine for producing the warp knit fabric, a variety of possible designs exists. Thus the knitting-needle bars may be arranged in tandem. However, a design according to which the knitting-needle bars are superposed is more advantageous, since then the knitting machines can have essentially the same length. Then the knitting needles may preferably be clamped. Clamping of the knitting needles from behind is alternatively possible. In this case, a design according to which the knitting-needles have dovetail-shaped shoulders which are held in corresponding clamping devices of the knitting-needle bars is particularly of advantage.

As a rule, the knitting needles of both needle bars are designed identical. However, when yarns of unlike properties are to be processed with the knitting needles of the individual needle bars, a design according to which the knitting-needles of one of the knitting-needle bars are designed more slender than the knitting-needles of the other needle bars is alternatively advantageous.

The tips of the knitting needles of the two needle bars may conceivably lie in unlike planes. However, it is more advantageous if at least the tips of the knitting needles of the two needle bars lie in a common plane. At the same time, it is preferable when the knitting needles are guided by arranging the knitting-needles of two knitting-needle bars on a common knockover bit having comb-like guide recesses. But guiding by arranging the knitting needles of the two knitting-needle bars on a common flat knockover bit without lateral guidance is alternatively possible, whereby in particular the lateral distance apart of adjacent knitting needles can be kept especially small.

The knitting-needle bars may be out of phase by an angle other than 180°. However, it is advantageous if the knitting-needle bars can be actuated 180° out of phase with one another, because at 180° the displacement of the stitches amounts to the length of exactly one-half stitch. The needle bars are preferably driven by cranks or cam drives.

The arrangement of the warp thread guides on a common axle demands only a small space requirement and yet permits an individual drive of the warp thread guide sets for the separate needle bars. The warp thread guides of each needle bar are preferably linked with their drive. However, it is alternatively possible to design the warp thread guides for the two needle bars so as to be arranged on a common warp thread laying device whose drive speed is twice as great as that of the needle bars, but then a direct linkage of the drive of the warp thread laying device with the needle bars is not possible. The warp-thread laying device must work twice as fast as a needle bar, since the same warp-thread laying device must service two needle bars.

In principle, it is possible to control a full filling thread guide so that in each instance it is only brought into action when a course of first stitches is formed. However, it is advantageous if the weft knitting machine has a full filling thread guide which, in the formation of a course of first stitches as well as of a course of second stitches, is capable of moving across the width of the fabric web, since this results in each stitch containing two filling threads. This produces a particularly stable and tight warp knit fabric.

BRIEF DESCRIPTION OF THE INVENTION

Examples of the subject matter of the invention are described below in detail by means of the drawings, wherein FIG. 1 shows the section of a first warp knit fabric, which contains only complete filling threads;

FIG. 2, the section of a warp knit fabric according to FIG. 1, wherein additional partial filling threads are arranged within the warp thread stitch wales;

FIG. 3, the section of a warp knit fabric according to FIG. 2, wherein a additional partial filling thread is laid with regard to pattern;

FIG. 4, a weft knitting machine in section and through section IV—IV of FIG. 5;

FIG. 5, the weft knitting machine of FIG. 4 through section V—V of FIG. 4;

FIGS. 6 and 7, the mode of operation of the knitting needles, warp thread guides and filling thread guides in various stages of production, in diagrammatic representation;

FIG. 8, the device of FIG. 6, but with only one type of warp thread guides; and

FIG. 9, the travel diagram of the elements of FIGS. 6 and 7.

DETAILED DESCRIPTION OF THE INVENTION

Figure 1:
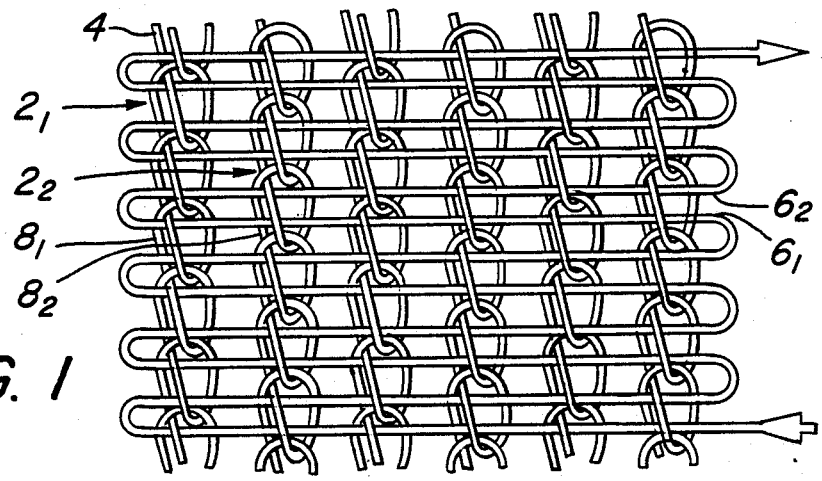

FIG. 1 shows the section of a warp knit fabric which is formed of warp thread stitch wales $2_1$ and $2_2$, which wales are knitted of a warp thread 4 and connected together by means of full filling threads $6_1$, $6_2$. The stitches $8_2$ of every second warp thread stitch wale $2_2$ are displaced one-half stitch with respect to the stitches $8_1$ of every first warp thread stitch wale $2_1$. In each instance, two full filling threads $6_1$, $6_2$ are arranged in each stitch $8_1$, $8_2$. This results in an especially tight and fine texture of the warp knit fabric. In itself, it is alternatively possible for the warp knit fabric shown in FIG. 1 to be produced with only one filling thread per stitch from time to time, in that every second full filling thread is omitted and insertion of the full filling thread takes place only when stitches of the first warp thread stitch wales $2_1$ or second warp thread stitch wales $2_2$ are formed.

Figure 2:
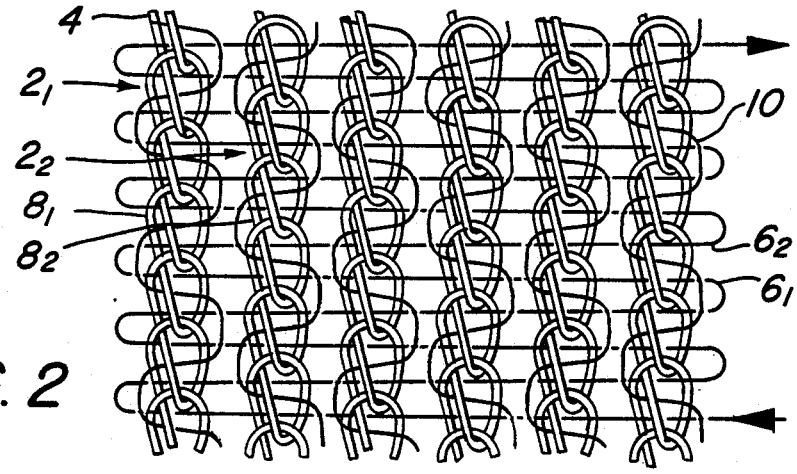

FIG. 2 shows a warp knit fabric according to FIG. 1, so that like parts are provided with like reference numerals. In addition, the warp knit fabric is further provided with partial filling threads 10 which, however, run only within the warp thread stitch wales $2_1$ $2_2$. Such partial filling threads 10 may be variously-colored pattern threads or a rubber thread, which imparts particularly elastic properties to the warp knit fabric.

Figure 3:
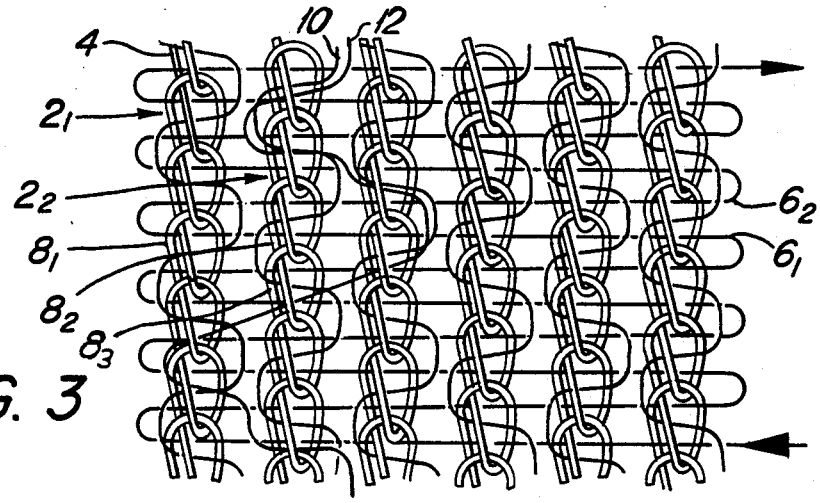
Figure 4:
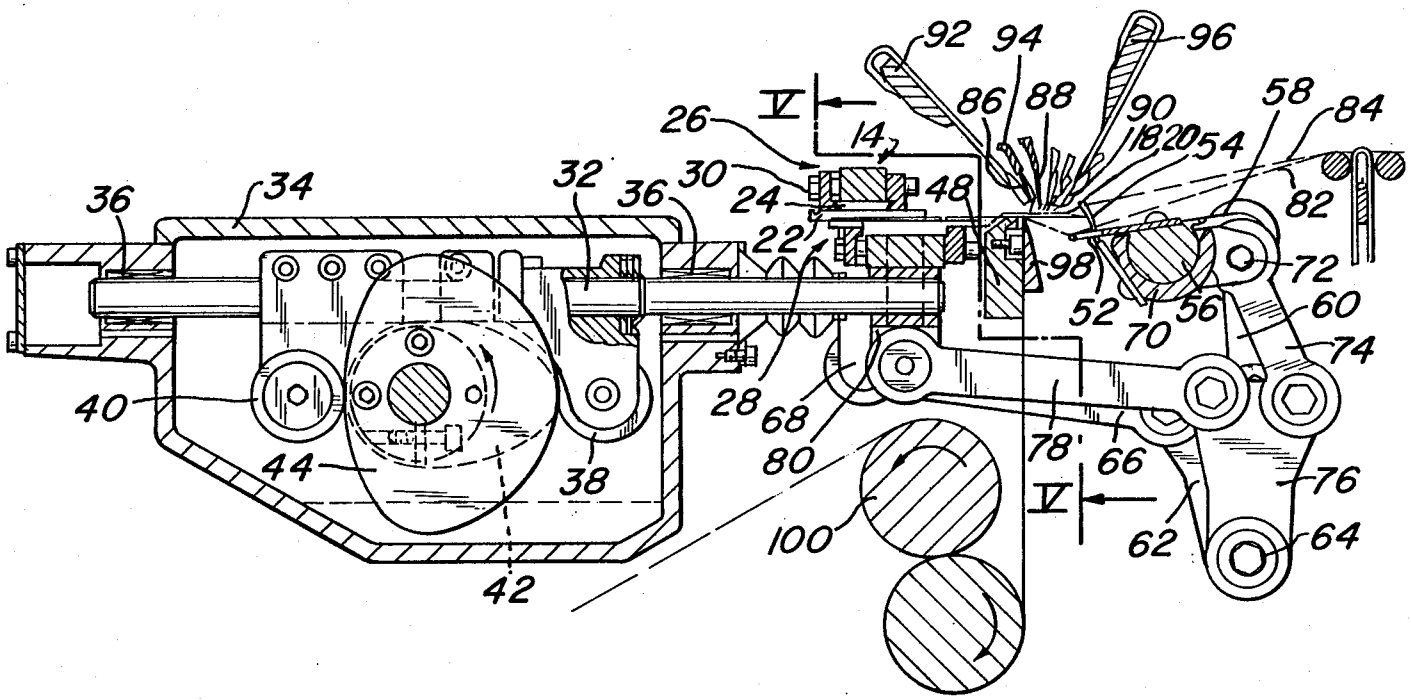

FIG. 3, in turn, shows a warp knit fabric pursuant to FIG. 2, so that like parts are again provided with like reference numerals. In addition, the warp knit fabric of FIG. 3 is provided with an additional partial filling thread 12, which is guided with regard to pattern between any desired warp thread stitch wales $2_1$, $2_2$. Such a partial filling thread 12 may accordingly intersect a full filling thread $6_1$ in a stitch $8_3$.

FIGS. 4 to 7 show the parts essential to the invention of an otherwise known weft knitting machine for producing the warp knit fabric. In this connection, the said weft knitting machine contains two superposed knitting-needle bars 14, 16, each of which carries a set of knitting needles 18, 20. On their back shanks 22 the knitting needles 18, 20 have dovetail-like shoulders 24, by which they are each clamped into a clamping device 26, 28. Tightening screws 30 serve to secure the clamping devices 26, 28. Said screws 30 are accessible either from the back or from the upper side or the lower side of the knitting-needle bars 14, 16. The needle bars 14, 16 are fastened to push rods 32, which on the one hand serve to support the knitting-needle bars and, on the other, for the reciprocating drive of he needle bars 14, 16. The push rods 32 are guided displaceable in a housing 34 on two sleeve bearings 36. Two drive rollers 38, 40 are arranged on the push rods. The roller 38 cooperates with a feeding cam 42 and the roller 40 with a return cam 44, which are arranged on a drive shaft 46 in the housing 34. Such a push rod 32 is present for each needle bar 14 and 16, while the respective feeding cam and return cam are arranged 180° out of phase on the drive shaft 46, so that the corresponding push rods swing toward one another 180° out of phase.

Figure 6:
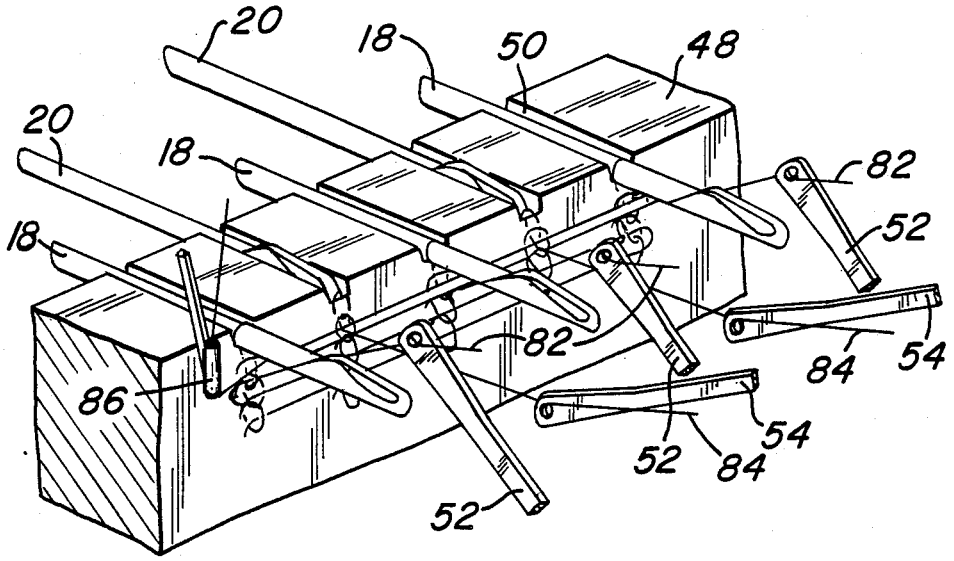
Figure 7:
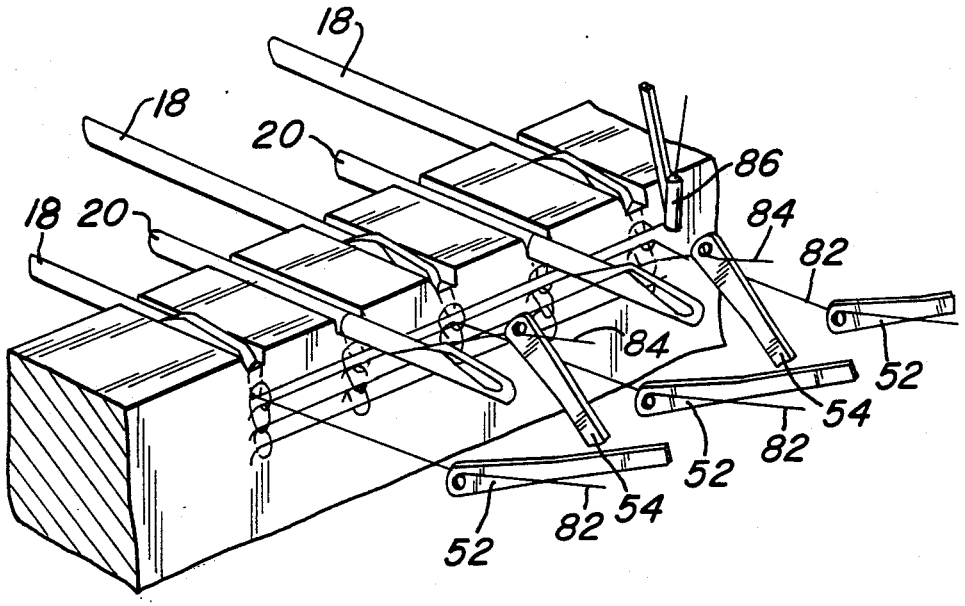
Figure 5:
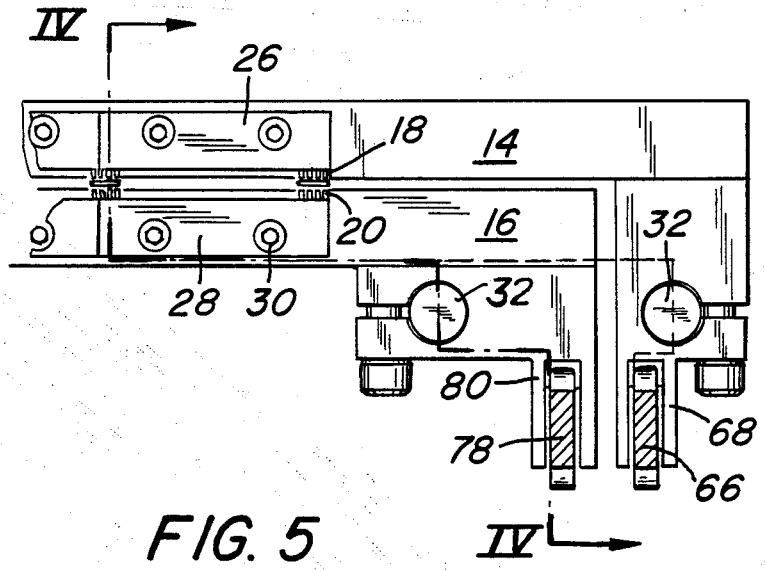

The knitting needles 18, 20, which for example are crochet needles, lie in a plane and are supported on a knockover bit 48, in which they are guided in guide recesses 50, as appears in particular in FIGS. 6 and 7. Each set of the needles 18, 20 is assigned a set of warp thread guides 52, 54, which likewise work out of phase.

The warp thread guides 52, which are assigned to the knitting needles 18, are fastened to a shaft 56, on which is arranged an arm 58, which is connected through a linking member 60 with a toggle lever 62. The lever 62, supported swinging on an axle 64, is connected with regard to drive through an additional linking rod 66 with a shoulder 68 of the knitting-needle bar 14. The warp thread guide 52 is thus moved up and down in vertical direction synchronously with the needle bar 14. The warp thread guides 54, which are assigned to the needles 20, are fastened to a sleeve 70 partially surrounding the shaft 56. The said sleeve likewise has an arm 72, which is connected through a linking member 74 with an additional toggle lever 76, which is capable of swinging on the axle 64. This lever 76 is connected with regard to drive through a linking rod 78 with a shoulder 80, which is fastened to the needle bar 16, so that the second warp thread guides 54 are turned, in vertical direction, synchronously with the second needles 20. A drive, not shown in detail, engages the shaft 56 in axial direction and serves for displacing the warp thread guides 52, 54 at least one needle spacing, so that the warp thread guides 52, 54 can each be conveyed at least one knitting needle 18, 20, in order to be able to lay a warp thread 82, 84 into a knitting needle 18, 20, as appears very clearly in FIGS. 6 and 7.

Above the knockover bit 48 and the advanced needles 18, 20 are additionally arranged a full filling thread guide 86 and a variety of partial filling thread guides 88, 90, some of which are designed as tube thread guides and some as guide needle thread guides. The guides are fastened to a variety of laying rods 92, 94, 96, which are designed, driven and controlled in conventional fashion.

The warp knit fabric produced is drawn off downward, in a slot formed between the knockover bit 48 and a guide strip 98, by a draw-off device 100.

Figure 9:
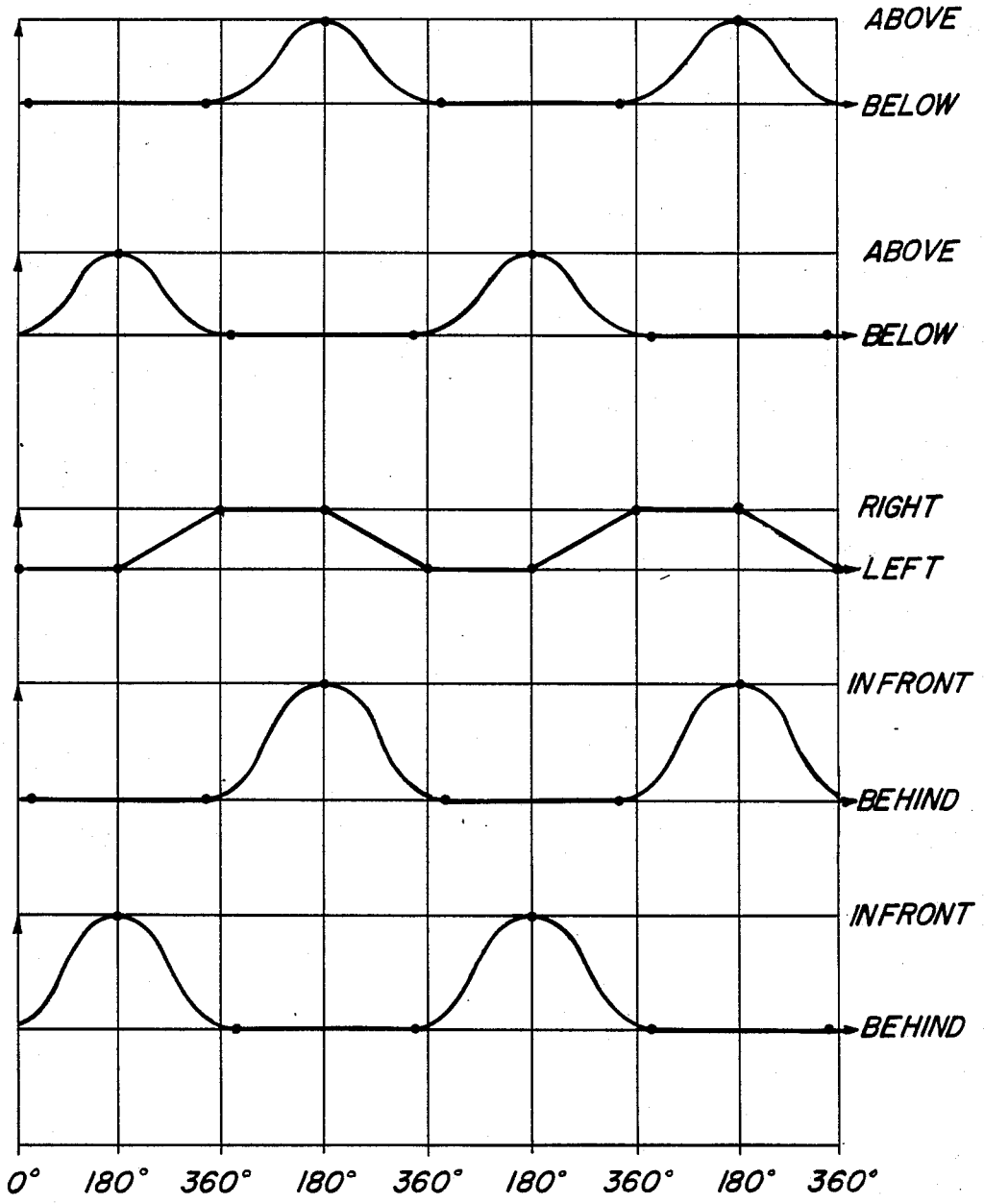

As appears in particular in FIGS. 6 and 7 and the travel diagram of FIG. 9, the first knitting needles 18 and the second knitting needles 20 are each alternately in action, specifically 180° out of phase (curves a and b). In FIG. 6 the first knitting needles 18 are advanced (curve a), while the first warp thread guides 52 lay warp threads 82 in the needles 18 (curve c). In this stage of work the second warp thread guides 54 (curve d), which are assigned to the second knitting needles 20 (curve b), are shown in retracted position, i.e., in the inferior position. The first knitting needles 18 are then retracted into the position shown in FIG. 7; in order to knock over a stitch. At the same time the full filling thread guide 86 (curve e) moves across the width of the goods to the right-hand side of FIG. 6 (not shown). Thereupon the second knitting needles 20 are advanced (curve b) and the warp-laying process is carried out at the second knitting needles 20, by mans of the warp thread guide 54, for the warp threads 84 (curve d), as shown in FIG. 7. During retraction and knockover of the stitches of the second needles 20, the full filling thread guide 86 is again moved to the left-hand side, before the first knitting needles 18 are run out. In this way, two filling threads are laid in each stitch, as shown in FIG. 1.

Figure 8:
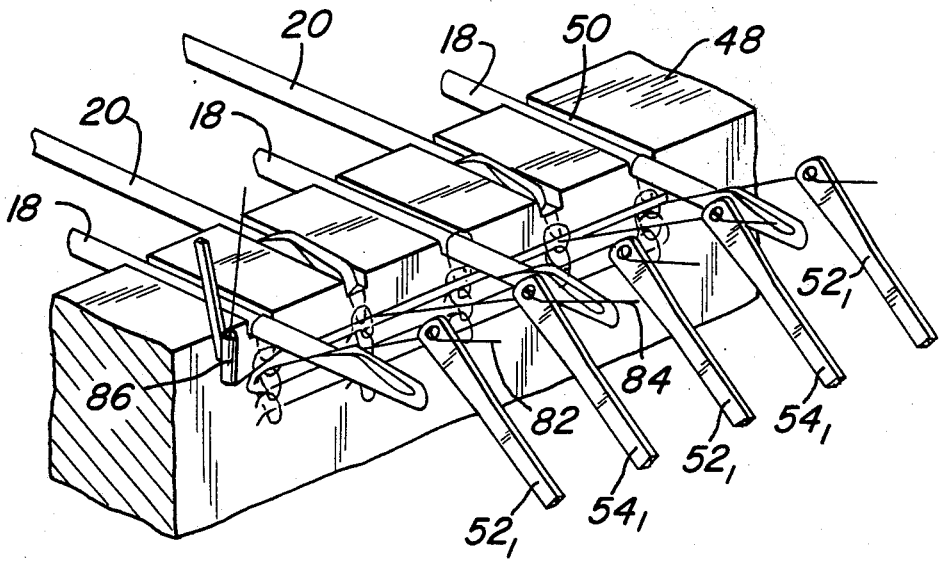

FIG. 8 shows another variant of the first warp thread guides $52_1$ and of the second warp thread guides $54_1$, which are arranged on a common laying rod, not shown in detail, and jointly moved. All warp thread guides $52_1$, $54_1$ perform the same motion while, however, only the first warp thread guides $52_1$ or the second warp thread guides $54_1$ are in action at a time and each of the other warp thread guides performs an idle motion. In contrast to the warp thread guides 52 and 54 of FIGS. 6 and 7, the warp thread guides $52_1$ and $54_1$ must have twice the speed.

I claim:

1. Knitting machine for producing a warp knit fabric including warp threads, the machine including knitting needles (18, 20) guided reciprocatingly to and from an advanced position transverse to a knockover bit, warp thread guides (52, 54, $51_1$, $54_1$,) for the needles, the warp thread guides being movable between the knitting needles for placing the warp threads on the knitting needles when the knitting needles are in the advanced position thereof, and at least one reciprocating filling thread guide (86) transverse to the needles (18, 20), the improvement comprising the knitting needles (18, 20) being uniformly distributed on upper and lower knitting-needle bars (14, 16), the knitting-needle bars lying on the same side of the goods, and being arranged alternately to one another and capable of being alternately driven, each knitting-needle bar (14, 16) being assigned a set of warp thread guides (52, 54, $52_1$,$54_1$).

2. Knitting machine according to claim 1, that the knitting-needle bars (14, 16) are arranged in tandem.

3. Knitting machine according to claim 1, wherein the knitting-needle bars (14, 16) are superposed.

4. Knitting machine according to claim 3, wherein the knitting needles (18) of the upper needle bar (14) are capable of being clamped from above and the knitting needles (20) of the lower needle bar (16) are capable of being clamped from below.

5. Knitting machine according to claim 1, wherein the knitting needles (18, 20) of the two needle bars (14, 16) are capable of being clamped from behind.

6. Knitting machine according to claim 1, wherein the knitting needles (18, 20) have dovetail-shaped shoulders, which are held in corresponding clamping devices (26, 28) of the knitting-needle bars (14, 16).

7. Knitting machine according to claim 1, wherein the knitting needles (18, 20) of one of the needle bars (14, 16) are designed slenderer than the knitting needles (20, 18) of the other of the needle bars (16, 14).

8. Knitting machine according to claim 1, the knitting needles having tips wherein at least the tips of the knitting needles (18, 20) of the two needle bars (14, 16) lie in a common plane.

9. Knitting machine according to claim 1, the knitting needles (18, 20) of the two knitting-needle bars (14, 16) are arranged on a common knockover bit (48) having comblike guide recesses (50).

10. Knitting machine according to claim 1, the knitting needles (18, 20) of the two knitting-needle bars (14, 16) are arranged on a common flat knockover bit without lateral guidance.

11. Knitting machine according to claim 1, the knitting-needle bars (14, 16) are actuable 180° out of phase with one another.

12. Knitting machine according to claim 1, the knitting-needle bars (14, 16) are actuable by means of cranks or cam drives (38, 40, 42, 44).

13. Knitting machine according to claim 1, wherein the warp thread guides (52, 54) of the two knitting-needle bars (14, 16) are arranged on a comon axle and are actuable out of phase.

14. Knitting machine according to claims 12 or 13, wherein the warp thread guides (52, 54) are each linked with regard to drive through a linkage having a toggle lever (62, 76) supported so as to be capable of swinging with the associated knitting-needle bar (14, 16) for performing a corresponding vertical swinging motion and wherein a common shaft (56) is capable of being displaced to and fro at least one needle spacing by means of a transverse drive.

15. Knitting machine according to claim 1, wherein the warp thread guides ($52_1$, $54_1$) for the two knitting-needle bars are arranged on a common warp thread laying device whose drive speed is twice as great as that of the knitting-needle bars.

16. Knitting machine according to claim 1, comprising it has a full filling thread guide (86) which, in the formation of a course of first stitches ($8_1$) of a course of second stitches ($8_2$), is capable of moving across the width of the fabric web.

* * * * *